US006688049B2

(12) United States Patent
Sanftleben et al.

(10) Patent No.: US 6,688,049 B2
(45) Date of Patent: Feb. 10, 2004

(54) HOOK FACILITY FOR CONCRETE STRUCTURE

(75) Inventors: Jeff Sanftleben, Canby, OR (US); Doug Bowen, Tualatin, OR (US)

(73) Assignee: Bowco Industries Inc., Portland, OR (US)

( * ) Notice: Subject to any disclaimer, the term of this patent is extended or adjusted under 35 U.S.C. 154(b) by 73 days.

(21) Appl. No.: 10/066,522

(22) Filed: Jan. 31, 2002

(65) Prior Publication Data

US 2003/0140575 A1 Jul. 31, 2003

(51) Int. Cl.[7] ..... E02D 35/00

(52) U.S. Cl. ..... 52/125.4; 52/124.2; 52/125.5; 52/704; 294/89

(58) Field of Search ..... 52/124.2, 125.1, 52/125.2, 125.3, 125.4, 125.5, 98, 701, 704, 706, 707; 294/89

(56) References Cited

U.S. PATENT DOCUMENTS

| | | | | | |
|---|---|---|---|---|---|
| 1,244,034 | A | * | 10/1917 | Cummings | 52/706 |
| 3,916,590 | A | * | 11/1975 | Miller | 52/124.2 |
| 4,304,431 | A | * | 12/1981 | Walston | 394/89 |
| 4,325,533 | A | * | 4/1982 | Tiletschke et al. | 249/188 |
| 4,443,980 | A | * | 4/1984 | Pennypacker | 52/125.4 |
| 4,807,843 | A | * | 2/1989 | Courtois et al. | 249/61 |
| 4,947,613 | A | * | 8/1990 | Fricker | 52/704 |
| 5,004,208 | A | * | 4/1991 | Domizio | 249/91 |
| 5,666,768 | A | * | 9/1997 | Gavin | 52/125.4 |
| 6,102,607 | A | * | 8/2000 | Kintscher | 403/291 |
| 6,460,824 | B1 | * | 10/2002 | Lanclot, III et al. | 249/91 |

FOREIGN PATENT DOCUMENTS

| | | | | |
|---|---|---|---|---|
| SE | 157453 | * | 1/1957 | 52/125 |
| WO | WO 02/44495 A1 | * | 6/2002 | E04C/5/12 |

OTHER PUBLICATIONS

Product literature or advertisement, "Pulling Iron Pockets," Pennsylvania Insert Corporation.

* cited by examiner

*Primary Examiner*—Brian E. Glessner
(74) *Attorney, Agent, or Firm*—Bennet K. Langlotz

(57) ABSTRACT

A pulling iron facility for encapsulation in a concrete structure has an elongated strength member with an intermediate portion forming an upwardly extending loop. The strength member has opposed end portions extending laterally away from the loop. A sleeve at least in part encapsulates the strength remember, and includes a planar flange below at least a portion of the loop and defining an enclosed loop aperture. The sleeve includes a number of protrusions spaced apart from the flange.

19 Claims, 3 Drawing Sheets

HOOK FACILITY FOR CONCRETE STRUCTURE

FIELD OF THE INVENTION

The invention relates to facilities cast into concrete structures, and more particularly to pulling irons or hooks for such structures.

BACKGROUND AND SUMMARY OF THE INVENTION

Lifting hooks or pulling irons are facilities embedded in concrete structures. They are engaged by devices that require a solid mount to generate tension. Such devices may include tensioners used to pull wires and cables, or lifting apparatus such as the hook of a crane's cable used to support a structure for installation. One such structure is a concrete utility vault, which is an open-topped box that is placed in an excavation, and which has apertures in the side walls to receive utility lines. Several pulling irons are normally embedded in the interior wall surfaces, so that wire pulling devices may be used to pull utility lines.

To facilitate construction, especially casting of the structures, the pulling irons are recessed within the volume of the wall, and do not protrude beyond the plane of the wall. The hooks are kept accessible by the use of pocket elements that are essentially bowls whose rims are positioned at the wall surface where the hook is to be accessed. The hook is an articulated bar, such as of rigid cable, with an inverted V-shaped loop portion that has a vertex extending into the bowl's cavity, and with legs of the V and laterally extending end portions embedded in the concrete, attached to reinforcing bars within the structure.

While functional, this configuration has several disadvantages. The bar's loop extends through a slot in the bowl. Prior to the structure being cast, the bar must be held in the desired position, and the bowl must be maintained with its rim against the surface of the form that will define the resulting wall surface. To prevent the bowl from pivoting and becoming misaligned during pouring of the concrete, the bowl and bar must be secured to each other. In existing designs, this is typically achieved by strapping the two elements together with duct tape, a time consuming and imprecise process. Moreover, even if the two are secured to each other to prevent concrete incursion into the bowl cavity, some angular misalignment may still result even when the bowl is flush to the form surface. This can occur when the bar ends are displaced, causing the bar loop to be closer of farther from the wall than is desired.

The embodiment disclosed herein overcomes these disadvantages by providing a pulling iron facility for encapsulation in a concrete structure. The facility has an elongated strength member with an intermediate portion forming an upwardly extending loop. The strength member has opposed end portions extending laterally away from the loop. A sleeve at least in part encapsulates the strength member, and includes a planar flange below at least a portion of the loop and defining an enclosed loop aperture. The sleeve includes a number of protrusions spaced apart from the flange.

DETAILED DESCRIPTION OF A PREFERRED EMBODIMENT

Figure 1:
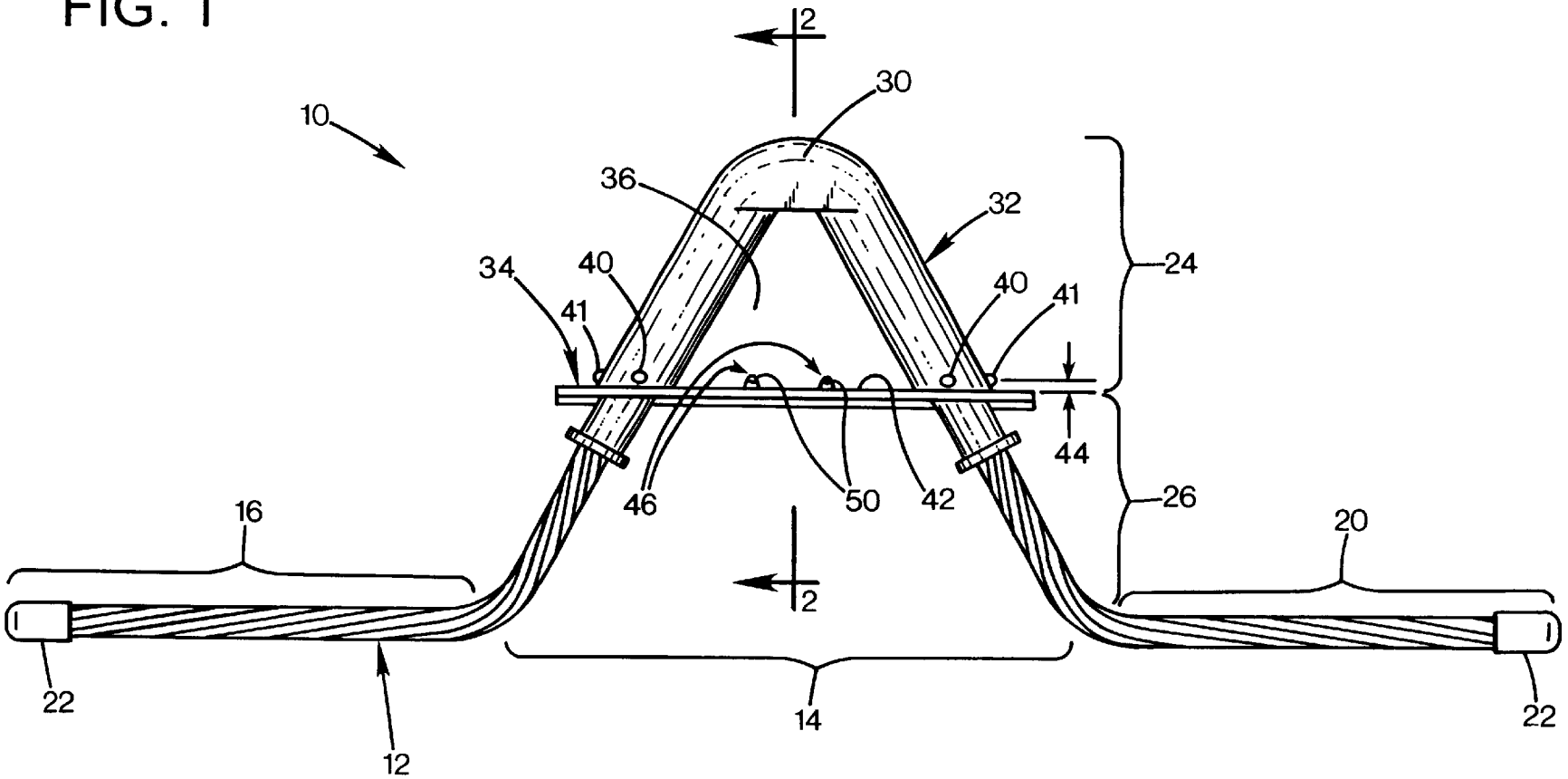
FIG. 1 is a plan view of a pulling iron element according to a preferred embodiment of the invention.

FIG. 1 illustrates a pulling iron bar 10. The iron includes an articulated single length of rigid steel cable 12. The cable has an intermediate portion 14 with the shape of an inverted V, with straight, co-linear end portions 16, 20 extending laterally from the lower spread ends of the V. The end portions are oriented horizontally as illustrated, and as installed in a typical application. Each end portion terminates at a free end covered with a safety cap 22.

The intermediate portion has an upper portion 24 and a lower portion 26. The upper portion includes the vertex 30 of the V, and the lower portion includes the lower halves of the legs of the V. The entire upper portion and upper parts of the lower portion are overmolded or encapsulated by a sleeve element 32. The sleeve is a rigid plastic body that includes a flat rectangular horizontal flange 34 that spans between mid points of the opposite legs of the V, essentially defining the boundary between the upper portion 24 and lower portion 26 of the intermediate portion 14. Together, the upper portion legs 24 and the flange 34 define an enclosed triangular aperture or loop 36.

The sleeve includes several protrusions 40, 41 that protrude laterally from the sleeve at locations just above the upper surface 42 of the flange. The protrusions occupy a common plane, and have lower edges spaced apart from the upper flange surface 42 by a gap 44. Side protrusions 40 extend from the faces of the sleeve in opposite directions perpendicular to the plane of the bar in opposed pairs, while end protrusions 41 extend from the sleeve in directions parallel to the end portions of the bar. A pair of latch elements 46 extends above the flange surface 42 at intermediate portions. The latch elements are elongated ridges that extend partly across the width of the flange, and have protrusions 50 at each end at the same spacing from the flange, and in line with the side protrusions 40.

In the preferred embodiment, the bar has an end-to-end length of 27", and a height from the line of the end portions to the vertex of 9". The flange is 8" long, 1⅝" wide, and ⅛" thick. The sleeve is 1⅛" thick at the upper portion 24, and the vertex extends 4½ inches upper surface of the flange. The protrusions each protrude 1/16" from their respective surfaces, so that the tip-to-tip dimension of each pair of side protrusions 40 or protrusions 50 is 1¼". The cable is ½" diameter 7-strand steel cable that resists appreciable bending under moderate loads.

Figure 2:
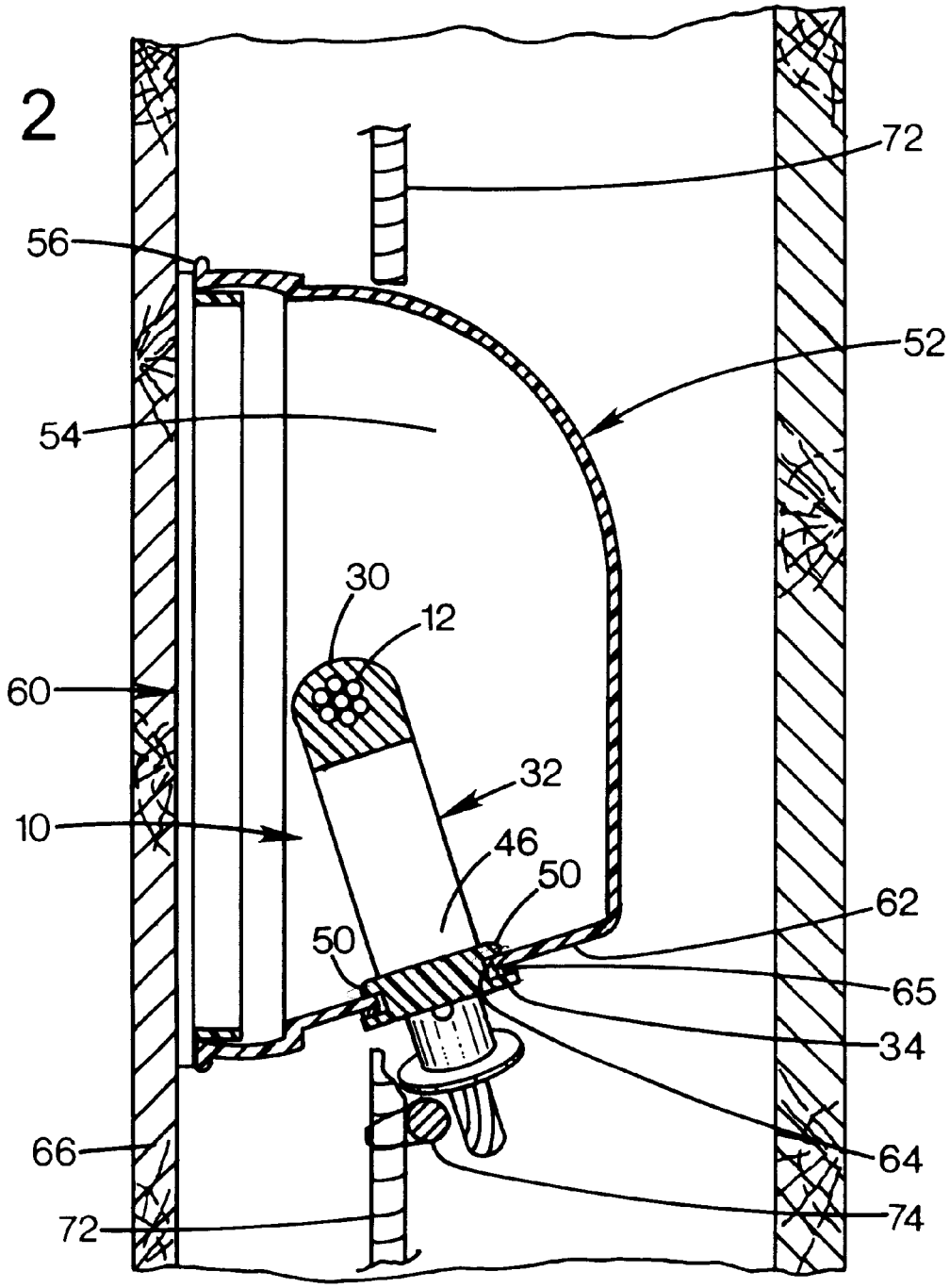
FIG. 2 is a sectional side view of a pulling iron facility taken along line 2—2 of FIG. 1.

FIG. 2 shows the bar 10 as installed for casting in a concrete wall of a structure. A plastic pocket or bowl 52 defines a cavity 54, and has a planar rim 56. A removable flat lid 60 mates with the bowl's rim to enclose the cavity. The bowl has a flat lower surface panel 62 that defines a rectangular slot 64. The slot is 1⅛" wide and 6⅛" long. The slot width is the same as the width of the sleeve upper portion for a snug fit, and is thus narrower than the span of the protrusions 40 and 50, so that the protrusions serve as latches to resist extraction or angular displacement of the bar. The length of the slot is sized similarly, so that it is smaller than the span between the tips of the end protrusions 41. A compressible closed cell foam gasket 65 is adhered to the exterior surface of the lower surface panel 62, to entirely surround the aperture 64. This prevents concrete from seeping into the cavity during casting. The wall thickness of the bowl at the lower panel is ⅛", including the thickness of the compressed gasket, which is the same as the gap between the protrusions and the flange upper surface. This tight fit prevents the bar from shifting with respect to the bowl.

The bar and bowl are latched together, and installed as shown before casting a concrete wall of the structure. Opposed wall form panels 66 define what will be the wall surfaces. The lid and rim rest flush against the interior surface of panel 66. A set of vertical reinforcing bars 72 is positioned between the forms, and a cross bar 74 is wired to span between a pair of vertical bars. The bar end portions 16 and 20 are wired to the cross bar. Thus suspended, the lid rests flat against the form surface 66.

Figure 3:
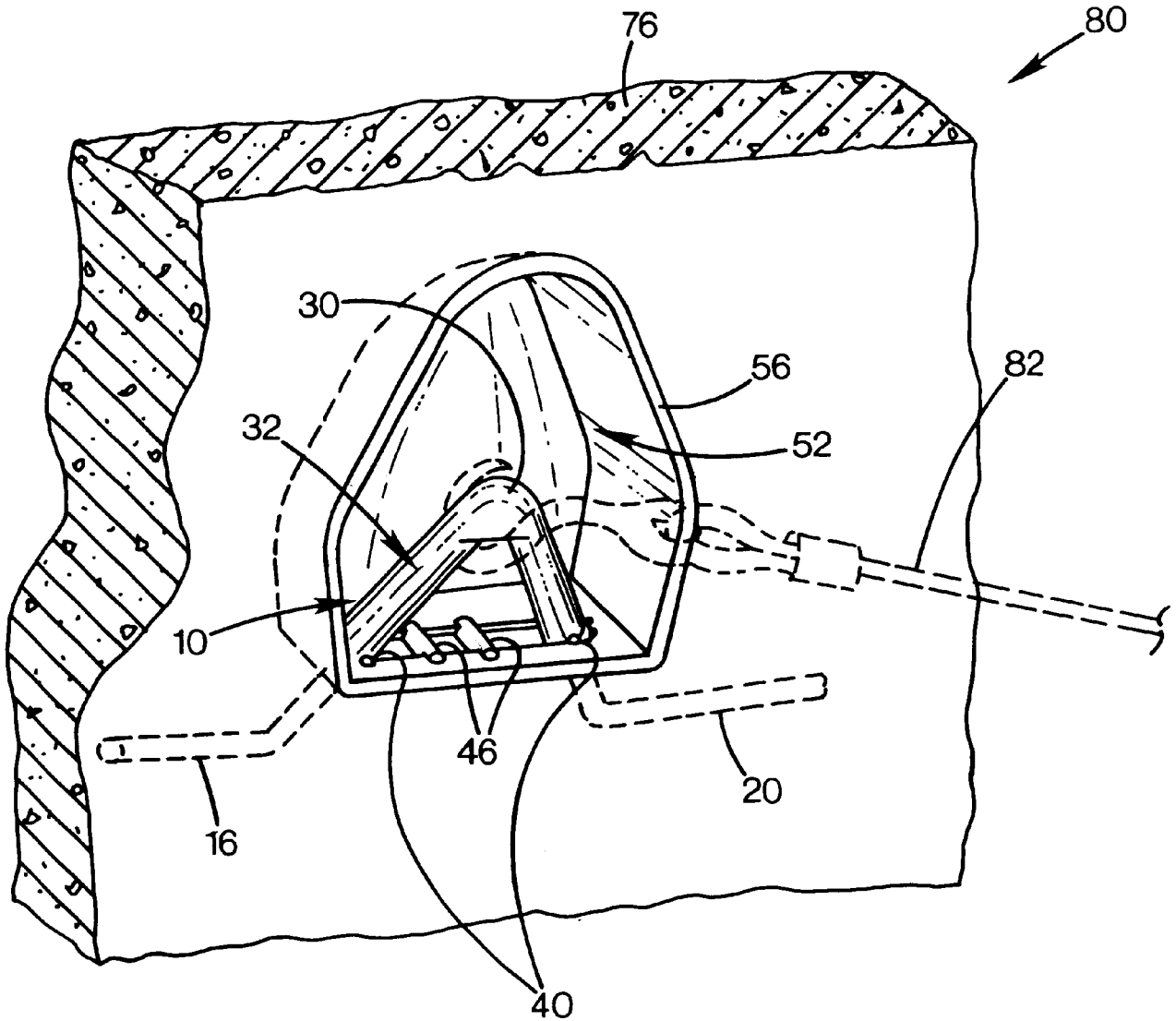
FIG. 3 is a perspective view of the facility as installed in a structure, according to the preferred embodiment.

FIG. 3 shows a concrete wall portion 76 of a structure 80, with the bar 10 and bowl 52 installed. The lid 60 has been removed for reuse, and the bowl rim 56 is exposed, surrounding the cavity. A hook-terminated pulling tackle 82 is shown attached to the bar. While the disclosure is made in terms of a preferred embodiment, the invention is not intended to be so limited.

What is claimed is:

1. A pulling iron facility for encapsulation in a concrete structure comprising:

an elongated strength member with an intermediate portion defining an upwardly extending loop;

the strength member having opposed end portions extending laterally away from the loop;

a sleeve at least in part encapsulating the strength member;

the sleeve including a planar flange below at least a portion of the loop and defining an enclosed loop aperture;

the sleeve including a plurality of protrusions spaced apart from the flange; and the flange having an upper face facing the loop, and wherein the protrusions are located proximate to and spaced above the face.

2. The facility of claim 1 wherein the strength member is a rigid steel cable.

3. The facility of claim 1 wherein the strength member has an inverted V-shape having a vertex and two leg ends, with lateral extensions from the leg ends of the V.

4. The facility of claim 1 wherein the sleeve is a rigid plastic molding.

5. The facility of claim 1 wherein the flange is a planar oblong plate.

6. The facility of claim 1 wherein the protrusions extend laterally from the sleeve.

7. The facility of claim 1 wherein the protrusions occupy a common plane parallel to the flange.

8. The facility of claim 1 including an intermediate latch element connected to an intermediate portion of the flange and having opposed protrusions spaced apart from the flange.

9. The facility of claim 1 including a pocket element having a bowl shape defining a cavity, with a rim defining a rim plane, and a sidewall defining an elongated aperture having opposed elongated parallel side edges spaced apart by a selected width less than the width of the flange.

10. The facility of claim 9 wherein the selected width is less than a distance defined along line perpendicular to the aperture side edges between a pair of opposed protrusions on the sleeve.

11. The facility of claim 9 wherein the selected width is sized to receive a portion of the sleeve, such that the loop resides in the cavity.

12. The facility of claim 9 including a planar lid sized to mate with the rim to enclose the cavity.

13. A lifting facility for encapsulation in a concrete wall comprising:

a bowl element defining a cavity and having a rim occupying a rim plane;

the bowl having a side wall defining an elongated bowl aperture;

an elongated strength member having a loop portion extending through the bowl aperture to occupy the cavity;

the strength member having end portions extending externally of the bowl;

the strength member including an overmolded sleeve element;

the sleeve element having a plurality of latch elements engaging the bowl; and wherein an edge portion of the bowl at the bowl aperture is captured between a flange and a latch element.

14. The facility of claim 13 including a concrete wall structure encapsulating at least a portion of the facility, the structure having a surface co planar with the rim plane, the bowl cavity being free of concrete such that the loop portion is accessible.

15. The facility of claim 13 wherein the strength member includes an overmolded sleeve element having a flange obstructing the bowl aperture and encompassing the strength element at two locations to define a loop aperture.

16. The facility of claim 13 wherein the end portions of the strength member are imbedded in the concrete.

17. A lifting facility for encapsulation in a concrete wall comprising a bowl element defining a cavity and having a rim occupying a rim plane;

the bowl having a side wall defining an elongated bowl aperture;

an elongated strength member having a loop portion extending through the bowl aperture to occupy the cavity;

the strength member having end portions extending externally of the bowl;

the strength member including an overmolded sleeve element;

the sleeve element having a plurality of latch elements engaging the bowl; and wherein the latch elements are arranged in a pair each having protruding ends protruding in opposite directions, the ends spaced apart from each other by a selected span greater than a corresponding width of the bowl aperture.

18. A pulling iron facility for encapsulation in a concrete structure comprising:

an elongated strength member with an intermediate portion defining an upwardly extending loop;

the strength member having opposed end portions extending laterally away from the loop;

a sleeve at least in part encapsulating the strength member;

the sleeve including a planar flange below at least a portion of the loop and defining an enclosed loop aperture;

the sleeve including a plurality of protrusions spaced apart from the flange; and the protrusions occupying a common plane parallel to the flange.

19. The facility of claim 18 including an intermediate latch element connected to an intermediate portion of the flange and having opposed protrusions spaced apart from the flange.

* * * * *